US006033789A

United States Patent [19]

Saveker et al.

[11] Patent Number: 6,033,789

[45] Date of Patent: Mar. 7, 2000

[54] HIGH SPEED CUTTING TOOL

[76] Inventors: Jonathan James Saveker; Trevor David Bonnell, both of Solar Works, Cornwall Road, Smethwick, Warley B66 2JR, United Kingdom

[21] Appl. No.: 08/860,714

[22] PCT Filed: Feb. 1, 1995

[86] PCT No.: PCT/GB95/00200

§ 371 Date: Sep. 11, 1997

§ 102(e) Date: Sep. 11, 1997

[87] PCT Pub. No.: WO96/21746

PCT Pub. Date: Jul. 18, 1996

[30] Foreign Application Priority Data

Jan. 11, 1995 [GB] United Kingdom ..... 9500503

[51] Int. Cl.[7] ..... B22F 7/02; B22F 7/06

[52] U.S. Cl. ..... 428/556; 419/6; 419/12; 419/14; 419/19; 419/23; 419/49; 419/60

[58] Field of Search ..... 428/545–546, 428/556; 419/6, 8, 12–19, 23, 49, 60; 148/405–407

[56] References Cited

U.S. PATENT DOCUMENTS 4,592,252 6/1986 Ecer ..... 76/108

4,618,540 10/1986 Holst ..... 428/552

4,630,692 12/1986 Ecer ..... 175/330

4,973,356 11/1990 Holst ..... 75/233

5,053,284 10/1991 Noda ..... 428/552

5,106,576 4/1992 Noda ..... 419/8

5,403,670 4/1995 Ohsue ..... 428/564

*Primary Examiner*—Timothy M. Speer

*Assistant Examiner*—Bryant Young

*Attorney, Agent, or Firm*—Oblon, Spivak, McClelland, Maier & Neustadt, P.C.

[57] ABSTRACT

The tool includes at least one cutting edge formed by a compacted mixture of carbide containing alloy steel and an oxide containing ceramic material, preferably zirconium oxide in an amount of 0.01–15 wt % of the mixture, preferably in the region of 1 to 6 wt %, advantageously in the region of 3 wt %. The mixture may additionally include particles of a hard or abrasive material, such as silicon carbide or aluminum carbide or a boride/carbide such as aluminum titanium diboride-titanium carbide.

42 Claims, No Drawings

HIGH SPEED CUTTING TOOL

TECHNICAL FIELD

The present invention relates to a high speed cutting tool, the material of which it is constructed, and the method of making such a tool. More particularly, the invention relates to materials formed by compaction of powdered materials.

BACKGROUND ART

It is known to produce metallic bodies by hot isostatic pressing (hip-ing) of powdered steel. In this procedure, the steel powder is compacted physically within a tube which is then evacuated of gas and sealed. The tube is then placed in a furnace and heated to a temperature in the region of 1050 to 1250° C., usally 1100–1200° C. An inert gas such as argon is supplied to the furnace at a desired pressure which may be in the region of 103 MPa. The cycle time may be in the region of 2 to 6 hours, allowing slow cooling. The powder in the tube is thereby compacted to form a unitary steel body which is cohesive, homogenous, and substantially free of potential stress fractures.

It is also known to make high speed and other cutting. tools from materials such as carbide containing steel, or from other steels. However, the high speed at which they operate, which may be 20,000 rpm, causes a high degree of wear at the cutting edges of the tool. Attempts have been made to extend the life of the tool by coating the edges with titanium nitride, which will lower the coefficient of friction by up to one third. However, this is not entirely satisfactory since the titanium nitride coating quickly wears away so as to leave an unlubricated utting edge, which becomes blunt even more quickly.

DISCLOSURE OF THE INVENTION

It is an object of the present invention to provide a high speed cutting tool and a material from which it is constructed which enables the cutting tool to give improved performance for a longer period of use.

BEST MODE FOR CARRYING OUT THE INVENTION

According to a first aspect of the present invention there is provided a cutting tool comprising at least one cutting edge formed by a compacted mixture of carbide containing alloy steel and a ceramic material.

Preferably the mixture of at least one cutting edge comprises additionally particles of a hard or abrasive material.

The abrasive material may comprise 0.01–15 wt % of the mixture, optionally in the region of 1 to 10 wt %.

The abrasive material may comprise a carbide, such as silicon carbide or aluminium carbide or a boride/carbide such as aluminium titanium diboride-titanium carbide.

The ceramic material preferably comprises 0.01–15 wt % of the mixture, optionally in the region of 1 to 6 wt %.

In preferred embodiments, the amount of ceramic material may be 2 to 5 wt %, advantageously in the region of 3 wt %.

The ceramic material may comprise zirconium oxide, optionally stabilised by a minor amount of calcium oxide.

The ceramic material may have a particle size in the region of 1 to 15 $\mu$m, preferably 1 to 4 $\mu$m.

The steel may have a particle size of less than or equal to 500 $\mu$m.

The hardness of the steel body formed from the powder may vary slightly with the powder size but is generally in the region of 270 to 295 Hv20, which is increased after hardening.

Particles of carbide in the steel may have a size in the region of 3 to 5 $\mu$m.

According to a second aspect of the present invention there is provided a metallic body comprising a steel core zone and a peripheral zone comprising a compacted mixture of carbide containing alloy steel and a ceramic material.

The core zone may comprise a compacted mass of powdered alloy steel.

The core zone may alternatively or additionally comprise a core of mild or other steel.

The peripheral zone may additionally comprise particles of a hard or abrasive material.

The abrasive material may comprise 0.01–15 wt % of the mixture, optionally in the region of 1 to 10 wt %.

The abrasive material may comprise a carbide, such as silicon carbide or aluminium carbide or a boride/carbide such as aluminium titanium diboride-titanium carbide.

The ceramic material preferably comprises 0.01–15 wt % of the mixture, optionally in the region of 1 to 6 wt %.

In preferred embodiments, the amount of ceramic material may be 2 to 5 wt %, advantageously in the region of 3 wt %.

The ceramic material may comprise zirconium oxide, optionally stabilised by a minor amount of calcium oxide.

The density of zirconium oxide is approximately 6 g/cm3, rendering it compatible for powder metallargy for combination with steel powder having a density in the region of 8 g/cm3.

The ceramic material may have a particle size in the region of 1 to 15 $\mu$m, preferably 1 to 4 $\mu$m.

The steel may have a particle size of less than or equal to 500$\mu$m.

Particles of carbide in the steel may have a size in the region of 3 to 5 $\mu$m.

The size of the ceramic powder may be selected to be greater than that of the general size of carbide particles.

According to a third aspect of the present invention there is provided a method of manufacturing a metallic body comprising the steps of providing a core of steel material, locating said body substantially centrally within a tube and filling an annular space between the core and the tube with a powdered mixture of steel and ceramic material, substantially evacuating the tube, sealing the tube, heating the tube at a high temperature, preferably in the region of 1000° C.–1300° C., supplying an inert gas external of the tube at a high pressure, preferably in the region of 14000–16000 psi, whereby the annular mixture is compacted and bonded to the core to form a unitary body.

The powdered mixture may comprise 0.1 to 15 wt % ceramic material, preferably 1 to 6 wt %, most advantageously in the region of 3 wt %.

The powdered mixture may additionally comprise 0.1 to 15 wt % hard or abrasive material, preferably 1 to 10 wt %.

The core of steel material may be formed from a powdered steel which is compacted concurrently with the mixture of steel and ceramic and optionally abrasive material in the peripheral zone.

Preferably said core may comprise powdered alloy steel.

Alternatively said core may comprise an iron containing body, which may optionally be surrounded by an intermediate zone comprising powdered alloy steel.

The powdered steel/ceramic mixture, and where appropriate, the powdered steel may comprise particles preferably of diameter no more than 500 $\mu$m.

Advantageously, the powdered alloy steel when compacted, contains carbide particles of size within the range of 3–5 μm.

The ceramic material provided in the mixture may comprise zirconium oxide optionally stabilised with calcium oxide.

Preferably, such zirconium oxide has a particle size greater than that of the carbide particles, preferably within the range 1 to 4 μm.

The abrasive material may comprise 0.01–15 wt % of the mixture, optionally in the region of 1 to 10wt %.

The abrasive material may comprise a carbide, such as silicon carbide or aluminium carbide or a boride/carbide such as aluminium titanium diboride-titanium carbide.

According to a fourth aspect of the present invention, there is provided a method of manufacturing a cutting tool, comprising the steps of forming a unitary body as described in the third aspect above, compacting the body, rough forming an exterior surface of the body to have at least one cutting zone, annealing and heat treating said body to cause hardening, and forming said at least one cutting zone to have a cutting edge.

Where the cutting tool is a gear cutting hob, the thickness of the peripheral steel/ceramic zone may be in the region of 1 to 2 inches (2.5 to 5.1 cm), some of which is removed to leave outstanding cutting edges comprising the steel/ceramic mixture, or the steel/ceramic/abrasive mixture.

Embodiments of the present invention will now be more particularly described by way of example.

Steel used as the basis in this example comprises the following; by wt %:

| | | | | |
|---|---|---|---|---|
| C | 1.27 | 1.2 | 1.3 | 2.3 |
| Mn | 0.27 | 0.3 | 0.3 | 0.4 |
| Cr | 4.04 | 4.0 | 4.2 | 4.0 |
| Mo | 4.52 | 4.8 | 5.2 | 7.0 |
| V | 2.03 | 2.9 | 3.2 | 6.5 |
| Co | 8.14 | <0.1 | 8.6 | 10.4 |
| W | 6.04 | 6.2 | 6.4 | 6.5 |
| Si | 0.27 | 0.3 | 0.55 | 0.5 |
| S | 0.03 | <0.1 | <0.1 | <0.1 |
| P | 0.02 | <0.1 | <0.1 | <0.1 |
| Ni | 0.09 | <0.1 | <0.1 | <0.1 |
| Cu | 0.04 | <0.1 | <0.1 | <0.1 |
| Nb | 0.01 | <0.1 | <0.1 | <0.1 |
| Ti | 0.005 | <0.1 | <0.1 | <0.1 |

In all cases remainder Fe and unavoidable impurities

Steels according to each of the above constitutions were powdered to a size of no more than 500 μm. The resulting powder was sieved to remove any oversized particles. The material was found to contain carbide particles, mostly, but not exclusively cobalt or tungsten carbide, which had a particle size of 3 to 5 μm.

The above powdered steel was then filled into a tube, located centrally within an outer tube. The annular space remaining was then filled with a mixture containing the same steel powder with the addition of 3 wt % zirconium oxide (stabilised by calcium oxide). This ceramic material had a particle size in a range of 1 to 4 μm.

The intermediate tube was then removed and the external tube and the contents thereof subjected to hot isostatic pressing (hip-ing). Gas from the tube is evacuated and the tube sealed. It is then placed in the furnace at a high temperature such as 1050 to 1250° C. and the furnace is subjected to a high pressure, such as 15,000 psi, by introduction of argon or some other inert gas. The powders are thereby compacted into a homogeneous unitary structure having a steel composition at its core and a steel/ceramic composition at its periphery.

In other Examples, the mixture contained additionally particles of a hard abrasive material such as silicon or aluminium carbide.

In some cases, it may be desirable to insert a central core of mild steel or other less expensive steel which may bond directly with the mixture of steel and ceramic, or may bond with an intermediate zone of compacted steel powder. Such a central core may be machined out if so required.

The material thus formed may then be converted into a high speed cutting tool, such as a gear cutting hob, a broach, a drill, a tap, a reamer, a shaper or any other similar cutting tool. One or more cutting edges may be formed roughly thereon, after which the material is annealed and hardened before final grinding is carried out to produce one or more cutting edges on the tool.

It has been found that tools embodying the present invention have a longer life, and it is thought that this may be due, in part, at least, to the heat absorbing properties of the ceramic material which enable the cutting edge to function at a lower temperature and thereby have a better edge retention. Given the high speed nature of the use of such tools (which may be as high as 20,000 rpm), the cooling effect should reduce or delay any tendency of the cutting edges to bluntness caused by frictional heating of the cutting edge.

Use of the invention also enables cutting tools to be manufactured from steels of lower hardness than is presently the case, for example from steel to British Standard M42, although it is equally applicable to harder steels such as those to BS T4.

We claim:

1. A cutting tool comprising at least one cutting edge formed by a compacted mixture of carbide-containing alloy steel and an oxide-containing ceramic material wherein the mixture forming at least one cutting edge comprises particles of a hard or abrasive material.

2. A cutting tool as claimed in claim 1, wherein the abrasive material comprises 0.01–15 wt % of the mixture.

3. A cutting tool as claimed in claims 1, or claim 2, wherein the abrasive material comprises a carbide, or a boride/carbide.

4. A cutting tool as claimed in claim 1, wherein the oxide-containing ceramic material comprises 0.01–15 wt % of the mixture.

5. A cutting tool comprising at least one cutting edge formed by a compacted mixture of carbide-containing alloy steel and an oxide-containing ceramic material, wherein the ceramic material comprises zirconium oxide.

6. A cutting tool as claimed in claim 1, wherein the ceramic material has a particle size in the region of 1 to 15 μm.

7. A cutting tool as claimed in claim 1, wherein the alloy steel has a particle size of less than or equal to 500 μm.

8. A metallic body as claimed in claim 7, wherein said core zone comprises a compacted mass of powdered alloy steel.

9. A metallic body which comprises a steel core zone and a peripheral zone comprising a compacted mixture of carbide-containing alloy steel and an oxide-containing ceramic material, wherein the peripheral zone additionally comprises particles of a hard or abrasive material.

10. A metallic body as claimed in claim 9, wherein the abrasive material comprises 0.01–15 wt % of the mixture, and comprises a carbide or a boride/carbide.

11. A metallic body as claimed in claim 9, wherein the ceramic material comprises 0.01–15 wt % of the mixture.

12. A metallic body as claimed in claim 9, wherein the ceramic material comprises zirconium oxide and having a particle size in the region of 1 to 15 μm.

13. A method of manufacturing a metallic body, comprising, providing a core of steel material, locating said core substantially centrally within a tube and filling an annular space between the core and the tube with a powdered mixture of steel and ceramic material, substantially evacuating the tube, sealing the tube, heating the tube at a temperature in the range of 1000° C.–1300° C., supplying an inert gas external of the tube at a pressure in the range of 14000–16000 psi such that the annular mixture is compacted and bonded to the core to form a unitary body wherein the powdered mixture comprises 0.1 to 15 wt % ceramic material.

14. A method as claimed in claim 13, wherein the powdered mixture additionally comprises 0.1 to 15 wt % of a hard or abrasive material.

15. A method as claimed in claim 14, which comprises forming the core of steel material from a powdered steel which is compacted concurrently with the mixture of steel and ceramic and an abrasive material in the peripheral zone.

16. A method as claimed in any one of claims 13–15, which comprises an initial step of selecting particles powdered steel/ceramic mixture in which the powdered steel has a diameter of no more than 500 μm.

17. A method as claimed in any one of claims 13, wherein the mixture comprises zirconium oxide optionally stabilised with calcium oxide, and having a particle size within the range 1 to 4 μm.

18. A method of manufacturing a cutting tool, comprising the steps of forming a unitary body as claimed in claim 13, which comprises the steps of compacting the body, rough forming an exterior surface of the body to have at least one cutting zone, annealing and heat treating said body to cause hardening, and forming said at least one cutting zone so as to have a cutting edge.

19. A method as claimed in claim 18, in which the cutting tool comprising a gear cutting hob, wherein the thickness of the peripheral steel/ceramic zone is in the range of 1 to 2 inches (2.5 to 5.1 cm), a portion of which is removed to leave outstanding cutting edges comprising the steel/ceramic mixture, or the steel/ceramic/abrasive mixture.

20. A cutting tool comprising at least one cutting edge formed by a compacted mixture of carbide-containing alloy steel and an oxide-containing ceramic material, said ceramic material comprising zirconium oxide.

21. A cutting tool as claimed in claim 20, wherein the mixture forming at least one cutting edge comprises particles of a hard or abrasive material.

22. A cutting tool as claimed in claim 21, wherein the abrasive material comprises 0.01–15 wt % of the mixture.

23. A cutting tool as claimed in claim 20, wherein the abrasive material comprises a carbide or a boride/carbide.

24. A cutting tool as claimed in claim 20, wherein the oxide-containing ceramic material comprises 0.01–15 wt %.

25. A cutting tool as claimed in claim 20, wherein the zirconium oxide is stabilized by an amount of calcium oxide.

26. A cutting tool as claimed in claim 20, wherein the ceramic material has a particle size in the region of 1 to 15 μm.

27. A cutting tool as claimed in claim 20, wherein the alloy steel has a particle size of less than or equal to 500 μm.

28. A metallic body which comprises a steel core zone and a peripheral zone comprising a compacted mixture of carbide-containing alloy steel and an oxide-containing ceramic material, said ceramic material comprising zirconium oxide.

29. A metallic body as claimed in claim 28, wherein said core zone comprises a compacted mass of powdered alloy steel.

30. A metallic body as claimed in claim 28, wherein said core zone comprises a core of steel.

31. A metallic body as claimed in any one of claims 28 to 30, wherein the peripheral zone additionally comprises particles of a hard or abrasive material.

32. A metallic body as claimed in claim 31, wherein the abrasive material comprises 0.01–15 wt % of the mixture and comprises a carbide or a boride/carbide.

33. A metallic body as claimed in claim 28, wherein the ceramic material comprises 0.01–15 wt % of the mixture.

34. A metallic body as claimed in claim 28, wherein the ceramic material comprises zirconium oxide and has a particle size in the region of 1 to 15 μm.

35. A method of manufacturing a metallic body, comprising:

providing a core of steel material, locating said core substantially centrally within a tube and filling an annular space between the core and the tube with a powdered mixture of steel and ceramic material comprising zirconium oxide, substantially evacuating the tube, sealing the tube, heating the tube at a temperature in the range of 1000° C.–1300° C., and supplying an inert gas external of the tube at a pressure in a range of 14000–16000 psi such that the annular mixture is compacted and bonded to the core to form a unitary body.

36. A method as claimed in claim 35, wherein the powdered mixture comprises 0.1 to 15 wt % ceramic material.

37. A method as claimed in claims 35 or 36, wherein the powdered mixture additionally comprises 0.1 to 15 wt % of a hard or abrasive material.

38. A method as claimed in claim 37, which comprises forming the core of steel material from a powdered steel which is compacted concurrently with the mixture of steel and ceramic and with an abrasive material in the peripheral zone.

39. A method as claimed in claim 35, which comprises an initial step of selecting particles of powdered steel/ceramic mixture in which the powdered steel has a diameter of no more than 500 μm.

40. A method as claimed in claim 35, wherein the mixture comprises zirconium oxide optionally stabilized with calcium oxide and which has a particle size within a range of 1 to 4 μm.

41. A method of manufacturing a cutting tool, comprising the steps of forming a unitary body as claimed in claim 35, which comprises compacting the body, rough forming an exterior surface of the body to have at least one cutting zone, annealing and heat treating said body to cause hardening, and forming said at least one cutting zone so as to have a cutting edge.

42. A method as claimed in claim 41, in which the cutting tool comprising a gear cutting hob, wherein the thickness of the peripheral steel/ceramic zone is in the range of 1 to 2 inches, a portion of which is removed to leave outstanding cutting edges comprising the steel/ceramic mixture, or the steel/ceramic/abrasive mixture.

* * * * *